US005152080A

United States Patent [19]

Wimberger

[11] Patent Number: 5,152,080

[45] Date of Patent: Oct. 6, 1992

[54] STEERABLE AIR BAR/EDGE DAM APPARATUS

[75] Inventor: Richard J. Wimberger, Depere, Wis.

[73] Assignee: W. R. Grace & Co.-Conn., New York, N.Y.

[21] Appl. No.: 719,688

[22] Filed: Jun. 25, 1991

Related U.S. Application Data

[63] Continuation of Ser. No. 5,152,080, Jan. 16, 1990, abandoned.

[51] Int. Cl.[5] ..... F26B 13/20; B65H 20/00

[52] U.S. Cl. ..... 34/156; 34/160; 226/15; 226/97

[58] Field of Search ..... 34/156, 160; 226/15, 226/97

[56] References Cited

U.S. PATENT DOCUMENTS

| | | | |
|---|---|---|---|
| 3,615,048 | 4/1969 | Martin | 226/20 |
| 3,680,223 | 8/1972 | Vits | 34/156 |
| 3,966,105 | 6/1976 | Curran | 226/21 |
| 4,138,047 | 2/1979 | Sherman | 226/7 |
| 4,182,472 | 1/1980 | Peekna | 226/97 |
| 4,197,972 | 4/1980 | Daane | 226/97 |
| 4,197,973 | 4/1980 | Daane | 226/97 |
| 4,282,998 | 8/1981 | Peekna | 226/97 |
| 4,288,015 | 9/1981 | Curtin | 226/97 |
| 4,480,777 | 11/1984 | Suzuki et al. | 226/97 X |
| 4,480,859 | 11/1984 | Rueckl et al. | 285/163 |
| 4,785,985 | 11/1988 | Hürtgen | 226/97 |
| 4,785,986 | 11/1988 | Daane et al. | 226/97 |
| 4,787,547 | 11/1988 | Hella et al. | 226/97 |
| 4,833,794 | 5/1989 | Stibbe et al. | 34/156 |
| 4,837,946 | 6/1989 | Hella et al. | 226/97 X |
| 4,843,731 | 7/1989 | Vits | 34/10 |
| 4,889,269 | 12/1989 | Long et al. | 226/15 X |

FOREIGN PATENT DOCUMENTS

| | | | |
|---|---|---|---|
| 0030362 | of 1897 | United Kingdom | 34/156 |
| 2126974 | 4/1984 | United Kingdom | 23/32 |

OTHER PUBLICATIONS

"Web Guidance Concepts and Applications", J. David Pfeiffer, TAPPI, Dec., 1977, vol. 60, No. 12.

"Update on the Guiding and Stabilizing of your Felts", Felt Facts, date and author unknown.

"Fluid Effects Associated with Web Handling", Kenneth L. Knox and Thomas L. Sweeney, Ind. Eng. Chem. Process Des. Develop., vol. 10, No. 2, 1971, pp. 201-205.

*Primary Examiner*—Henry A. Bennet
*Assistant Examiner*—Christopher B. Kilner
*Attorney, Agent, or Firm*—Kevin S. Lemack; William L. Baker

[57] ABSTRACT

An apparatus is provided which both floatingly supports a web, and maintains the web in a substantially straight path as it travels through a dryer. The apparatus comprises a steerable air bar assembly comprising: i) one or more adjustable air bars, each having an elongated surface from which air may be discharged, said surface being in opposing relation to the running web, and each having two ends; ii) air supply means, in fluid communication with the air bars; and iii) adjustment means for altering the orientation of the elongated surfaces of the adjustable air bars with respect to the running web. In a preferred embodiment the orientation of the surfaces is adjusted such that each said surface rotates about an axis which is substantially parallel to the longitudinal centerline of the running web. Said steerable air bar assembly is positioned in a web dryer such that the web is guided through the dryer in a substantially straight path. A plurality of such steerable air bar assemblies can be used in a web dryer. The dryer can also include one or more fixed air bars. Air bars can include back pressure means for creating an opposing force to urge the web back to a substantially centered position. Said back pressure means preferably comprises one or more edge dams preferably disposed at or near the ends of one or more fixed air bars in the web dryer.

19 Claims, 5 Drawing Sheets

STEERABLE AIR BAR/EDGE DAM APPARATUS

This is a continuation of co-pending application Ser. No. 07/464,831 filed on Jan. 16, 1990.

BACKGROUND OF THE INVENTION

This invention relates to web supporting apparatus and is more particularly concerned with a web supporting and guiding device for a web drying apparatus whereby a lengthwise moving web is floatingly supported and maintained in a straight path (i.e. centered with respect to the longitudinal centerline of the web) throughout the length of the web drying apparatus.

In drying a moving web of paper, film, or the like, it is desirable that the web be contactlessly supported during the drying operation, to avoid damage to the web itself or to an ink or coating on the web. One common arrangement for contactlessly supporting a web comprises upper and lower sets of air bars extending along a substantially horizontal stretch of the web. Air issuing from the lower set of air bars floatingly supports the web, and air issuing from the upper set of air bars steadies the web to maintain it substantially straight and at a substantially constant distance from the air bars of both sets. The air blown from both sets of air bars is usually heated to expedite web drying, and typically the air bar array is inside an enclosure which is maintained at a slightly subatmospheric pressure by an exhaust blower that draws off the volatiles emanating from the web.

Web dryers are used in many printing and graphics applications, such as the processing of photographic film, web offset printing, and other types of printing. In some applications, such as the processing of photographic film, web dryers having very long length, often as long as 150 feet, are commonly used. The greater the ratio of the length of the dryer to the width of the web (hereinafter referred to as the "length to width ratio"), the more susceptible the web is to minor forces that can cause the web to weave (move back and forth in a lateral direction) or shift (move laterally from the centerline and remain there). Also, some webs, such as thin plastic films, naturally take on a "banana-shaped" curve when they are laid flat, as in a dryer, thereby exacerbating the problems of web weave and shift. Web shifting and weaving may also result when the web tension is low, and when a lighter weight web, such as polyester film, is used.

When the travelling web exits the drying apparatus it is generally wrapped around one or more rotating take-up members, such as chill rolls. When web weave or shift takes place as the web travels through the dryer, the web will correspondingly shift or weave as it contacts the rotating take-up member. Unless the web can be brought back to a straight orientation with respect to the centerline, the web will not wrap properly and the press must be shut down. This results in costly downtime and waste.

Other problems may result from web weave or shift, e.g. if the web moves to one side or the other and stays in the new position it may not be centered on the press, resulting in an unacceptable product; if the web weave or shift is severe enough the web may break or tear, etc. These problems also force a shut-down of the press and thus a loss of valuable production time.

In the past, attempts have been made to circumvent web weave and shift by guiding the web using contact systems such as a series of rollers. These systems are undesirable as they may cause damage to the ink or coating on the web, and are therefore inefficient in situations where there is a high length to width ratio.

Thus it is desired to provide a means by which a web may be floatingly supported and urged in a substantially straight path at points in the dryer where it has a tendency to weave or shift as it travels through a web drying apparatus.

SUMMARY OF THE INVENTION

The problems of the prior art have been solved by the present invention, which relates to an apparatus for handling and guiding a running web. More particularly, the present invention relates to an apparatus which both floatingly supports a web, and maintains the web in a substantially straight path as it travels through a dryer. The present invention further relates to a dryer comprising such web handling and guiding apparatus.

The web handling and guiding apparatus of the present invention comprises a steerable air bar assembly comprising: i) one or more adjustable air bars, each having an elongated surface from which air may be discharged, said surface being in opposing relation to the running web, and each having two ends; ii) air supply means, in fluid communication with the air bars; and iii) adjustment means for altering the orientation of the elongated surfaces of the adjustable air bars such that the orientation of one or both of the surfaces is adjustable with respect to the running web. In a preferred embodiment, each said surface rotates about an axis which is substantially parallel to the longitudinal centerline of the running web. In addition, or alternatively, each said surface may rotate about an axis which is substantially perpendicular to the longitudinal centerline of the running web. Said steerable air bar assembly is positioned in a web dryer such that the web is guided through the dryer in a substantially straight path. One or more such steerable air bar assemblies can be used in a web dryer The dryer can also include one or more fixed air bars.

In a preferred embodiment of the invention, the apparatus further comprises in combination with the steerable air bar assembly, back pressure means for creating an opposing force to urge the web back to a substantially centered position. Said back pressure means preferably comprises one or more edge dams preferably disposed at or near the ends of one or more fixed air bars in the web dryer.

In one embodiment of the invention the air supply means of the steerable air bar apparatus comprises a header which is sealingly joined at one end to a flexible air duct. The air bar is disposed adjacent the header such that air flows from the air duct into the header, and from the header into the air bar.

In a further embodiment of the invention the orientation of the adjustable air bars is altered by adjustment means comprising a jack disposed at one end of the air bar assembly, and a pivoting support means disposed between the two ends.

In its method aspects the present invention relates to a method of guiding a web in a substantially straight path, e.g. as it passes through a web dryer apparatus, using apparatus according to the invention.

BRIEF DESCRIPTION OF THE DRAWINGS

FIG. 3-1, 3-2, and 3-3 are a schematic diagram showing the mechanism by which the edge dam alleviates web drift.

DETAILED DESCRIPTION OF THE INVENTION

Figure 1:
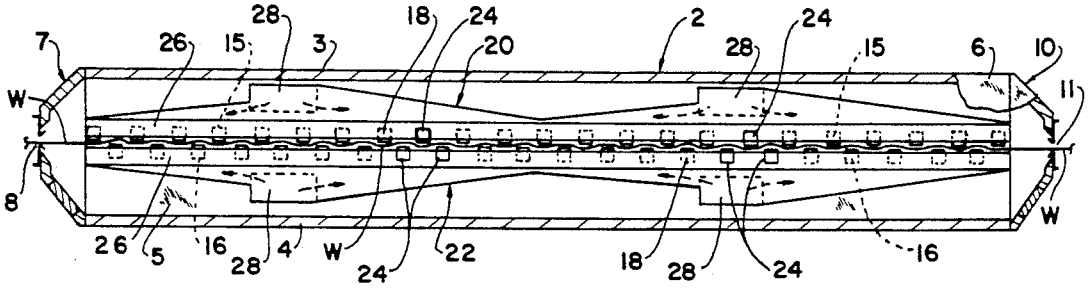
FIG. 1 is a vertical cross-sectional schematic view taken along the length of a web drying apparatus containing an apparatus for handling and guiding the web according to one embodiment of the invention.

A web drying apparatus for floatingly suspending a running web is shown in FIG. 1. FIG. 1 is illustrative of one type of web drying apparatus in which the guiding apparatus of the invention may be used. This apparatus includes an elongated dryer housing 2 which is enclosed by top 3, bottom 4, one side 5 and an opposite side 6. An inlet end 7 has a horizontal slot 8 through which web W enters. The opposite exit end is formed by the end wall 10 and a corresponding slot 11 therein through which web W exits. The dryer includes upper fixed air bars 15 and lower fixed air bars 16; a header frame 26 supporting and in air-delivering communication with the fixed air bars; and upper and lower air supply ducts 20 and 22, and central air supply ducts 28 which supply air to the headers. The upper and lower air bars are transversely positioned across the web, and are in staggered, spaced relationship along the web with respect to each other, such that they cause the web W to assume a conventional sine wave form, as shown in FIG. 1, when the dryer is in operation.

Figure 2:
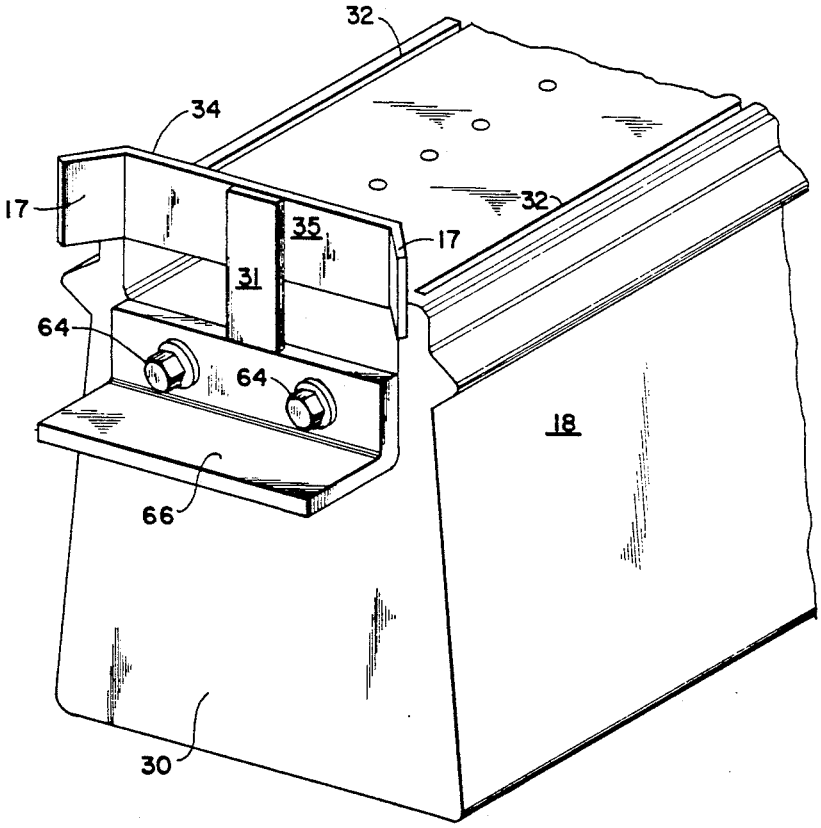
FIG. 2 is a fragmentary, enlarged perspective view of an air bar including an edge dam.

In order to illustrate the invention, the web drying apparatus shown in FIG. 1 has two fixed air bars 18 which each have two ends and which have back pressure means (as shown in FIG. 2 and discussed hereinbelow) disposed at at least one of each of their ends. The back pressure means serve to move the shifted web to its centered position, and are preferably present at least on those fixed air bars which are situated in areas of the dryer where the running web is prone to shifting. It is preferred that back pressure means be present on air bars which are situated approximately halfway along the length of the dryer, e.g. at 15 feet from the entrance to a 30 foot long dryer. It should be understood that as many of the air bars 15 and 16 as desired may also have back pressure means at their ends.

The steerable air bar assembly of the invention (shown in FIGS. 4 and 5) is shown schematically by air bars 24 of FIG. 1. These steerable air bars are not engaged to the header and upper and lower air ducts in the same manner as the fixed air bars, but are separately connected to extensions from headers 26 which are joined to the headers by a sealing flange and sealing gasket, as shown in FIG. 6 and as described in detail hereinbelow, such that a flexible seal is created between the standard header and the adjustable air bar assembly. Like the back pressure means, the steerable air bar assemblies may be present in the web drying apparatus in any number, and may be substituted for any number of the fixed air bars. In fact, all, or a grouping of upper and lower fixed air bars could be replaced by a single steerable air bar assembly comprising a similar number of steerable air bars. When it is desired to use only a few steerable air bar assemblies it is again desirable to situate them at locations in the dryer where web shift is anticipated, such as the lengthwise midpoint of the dryer.

A fragmentary, enlarged view of an air bar comprising back pressure means according to one embodiment of the invention is shown in FIG. 2. An edge dam 34 is shown mounted at end 30 of air bar 18. In the embodiment shown in FIG. 2, the edge dam is bolted to the end of the air bar, however any conventional method could be used to mount the edge dam, or it could be integral with the air bar. The edge dam 34 could also be located at points along the surface of air bar 18, depending in part on the width of the web. The edge dam is preferably, as shown in FIG. 2, a T-shaped member, formed by elongated dam member 35, which, in the embodiment shown, extends above and approximately perpendicular to surface 33 of air bar 18, and is supported in this position by support member 31. Support member 31 may be attached to the air bar by any suitable means, such as bolts 64 and air bar mounting bracket 66, as shown in FIG. 2. It is preferred that the dam member 35 have a fin 17 disposed at each of its ends, such that the web does not have a tendency to snag on the entering and leaving edges of the edge dam. In one embodiment the lower edge of dam member 35 is adjustable raised above surface 33 by support member 31, such that the distance between the lower edge and the surface may be from bout 5 cm to 60 cm. Vertical adjustment of dam member 35 provides a means for controlling the back pressure force, by allowing a portion of the escaping air to be relieved below the edge dam. This embodiment is typically used in applications where nozzle velocities are high, e.g. from 10,000 to 16,000 fpm, causing very high back pressure. In another embodiment of the invention, for use with lower nozzle velocities, dam member 35 could be fixed, with its lower edge close to or in contact with the surface of the air bar. It is generally preferred in this embodiment that the lower edge of the dam member be in intimate, sealing contact with the surface of the air bar. Dam member 35, with fins 17, is also preferably of a length such that each end of the elongated member is approximately aligned with the corresponding air bar slot 32.

Figures 1, 3:
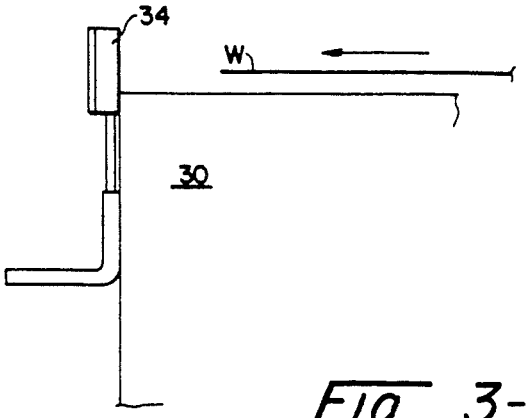
Figures 2, 3:
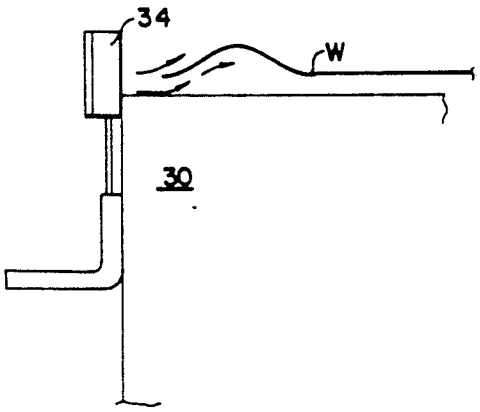
Figure 3:
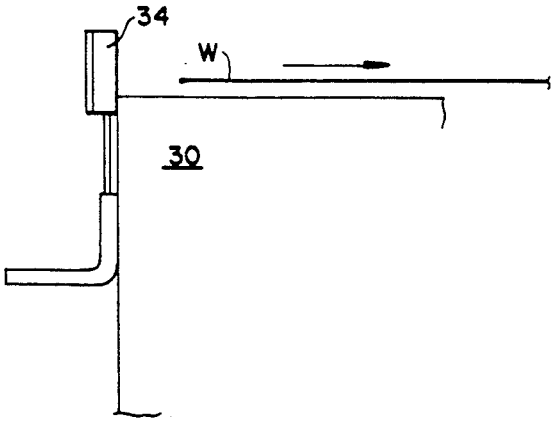

Although this configuration is preferred for the edge dam, any means may be used by which creates a back pressure against the web edge when the air bar is in use. This phenomenon is illustrated schematically in FIG. 3. In frame 1, one edge of web W approaches the edge dam 34 during web weave as the web passes over the air bar 30. In frame 2, the edge dam 34 creates a back pressure against web W, urging it back towards its initial path in frame 3. It is preferred that the back pressure means also be able to provide mechanical resistance against the web, should the air back pressure prove insufficient to return the web to its path. Thus if the web continued to travel toward the edge dam 34 in frame 2, it would eventually physically contact the edge dam and be forced back to its initial path.

Back pressure means may be disposed at either one or both ends of the air bar. It is generally preferred that back pressure means be disposed at both ends of the air bar, as it is usually difficult to predict in which direction the web will shift as it travels through the dryer. However, if the direction of web shift is known, then back pressure means may be placed only on the end of the air bar toward which the web will shift.

Figure 4:
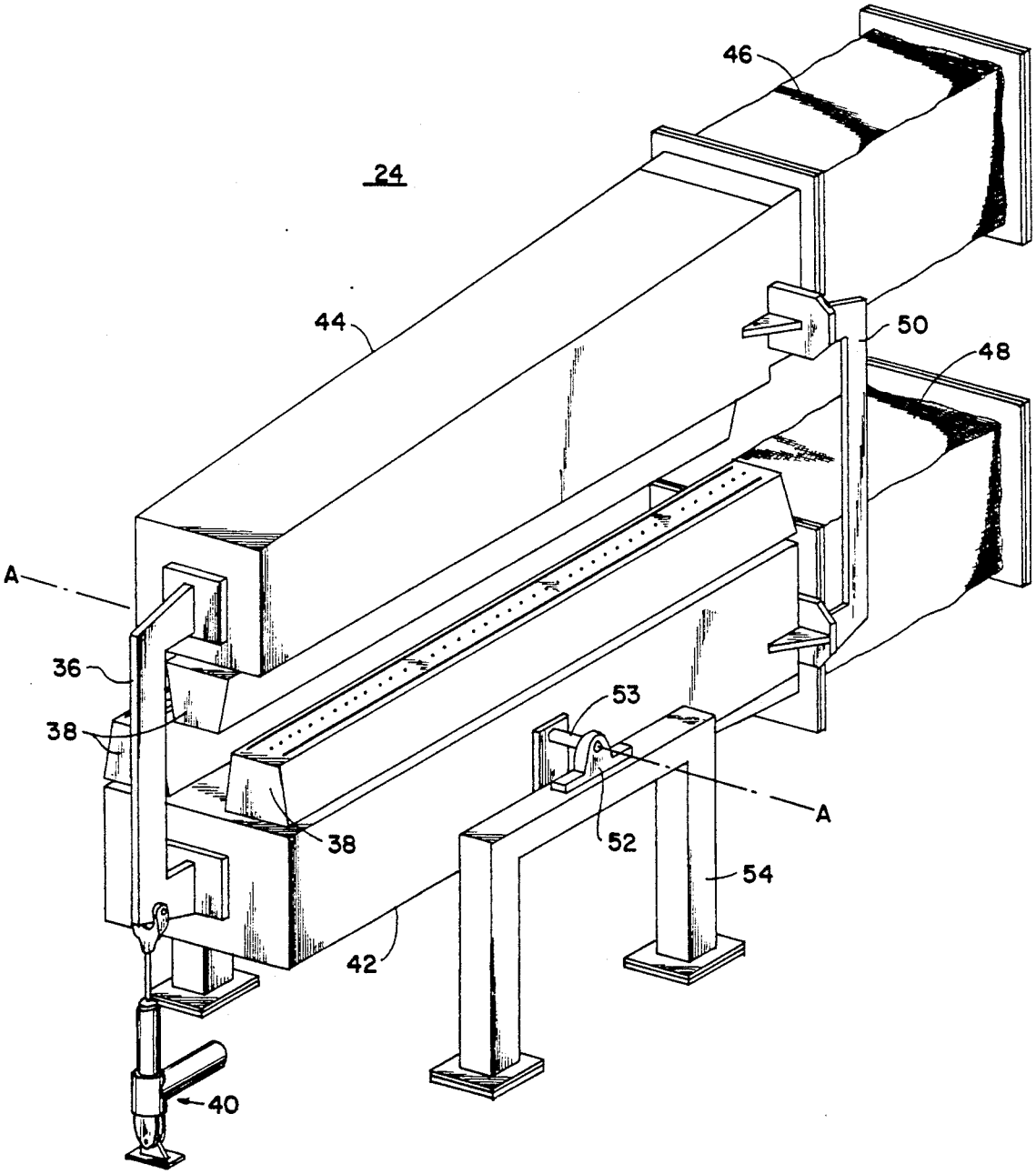
FIG. 4 is a perspective view of the steerable air bar assembly according to one embodiment of the invention.

A perspective view of a steerable air bar assembly 24, according to one embodiment of the invention, is shown in FIG. 4. In this embodiment, the assembly includes three adjustable air bars 38 supported by, and in air-receiving communication with, upper and lower headers 44 and 42. (The combinations of the two lower air bars and the lower header, and the single upper air bar and upper header 44 will hereinafter be referred to as the lower and upper air bar/header assemblies, respectively). The upper and lower air bar/header assemblies are maintained in opposing spaced relation by spacer means comprising header carriage 36 and support member 50, and upper and lower headers 44 and 42 are each sealingly joined at one of their respective ends to upper and lower flexible air ducts 46 and 48. Header carriage 36 is connected at its lower edge to screw jack 40, and the lower air bar/header assembly engages on each side a pivot bearing 52, supported by a support member 54, by means of a connecting rod 53. Thus, when screw jack 40 is adjusted up or down, the ends of both air bar/header assemblies adjacent screw jack 40 will correspondingly move up or down, as shown schematically in FIG. 5. The angular adjustment of the air bar/header assemblies is thus facilitated by a pivoting support means, comprising pivot bearings 52 and connecting rods 53, and an angular adjustment means, comprising screw jack 40, which allow the air bar/header assemblies to be rotated about an axis A which is substantially parallel to the longitudinal centerline of the running web, while being prevented from translational or rotational movement in any other plane. The presence of header carriage 36 and support member 50, allows this movement to take place without the spatial relationship among the air bars being altered. This simultaneous adjustment of the orientation of both the upper and lower air bars is further facilitated by flexible air ducts 46 and 48, which allow a sealing relationship to be maintained between upper and lower headers 44 and 42 and the air supply, regardless of the position of the headers. One type of flexible air duct which may be used in the invention is described in U.S. Pat. No. 4,480,859, the disclosure of which is incorporated herein by reference.

Figure 5:
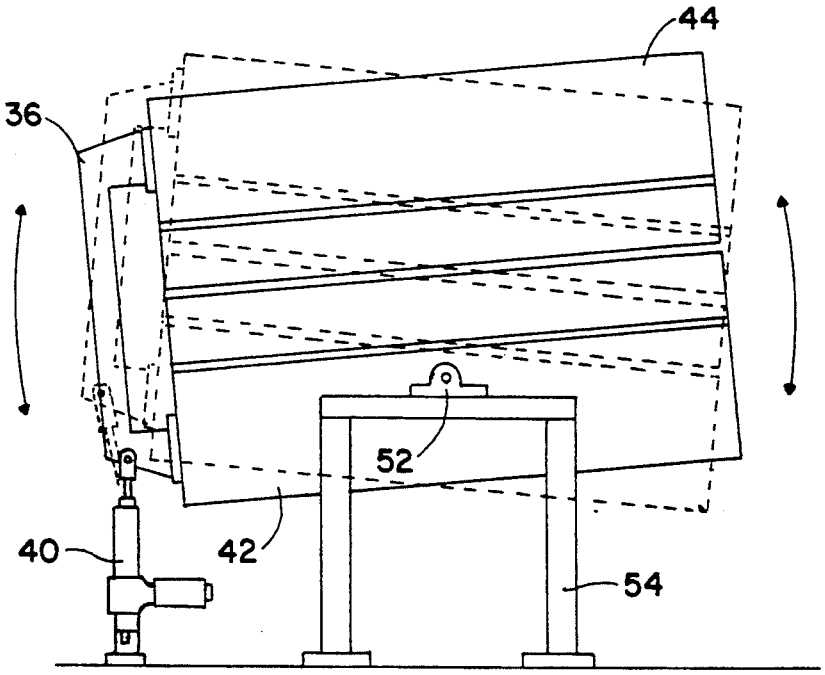
FIG. 5 is a front view of the apparatus of a steerable air bar assembly illustrating the steering of the air bars.
Figure 6:
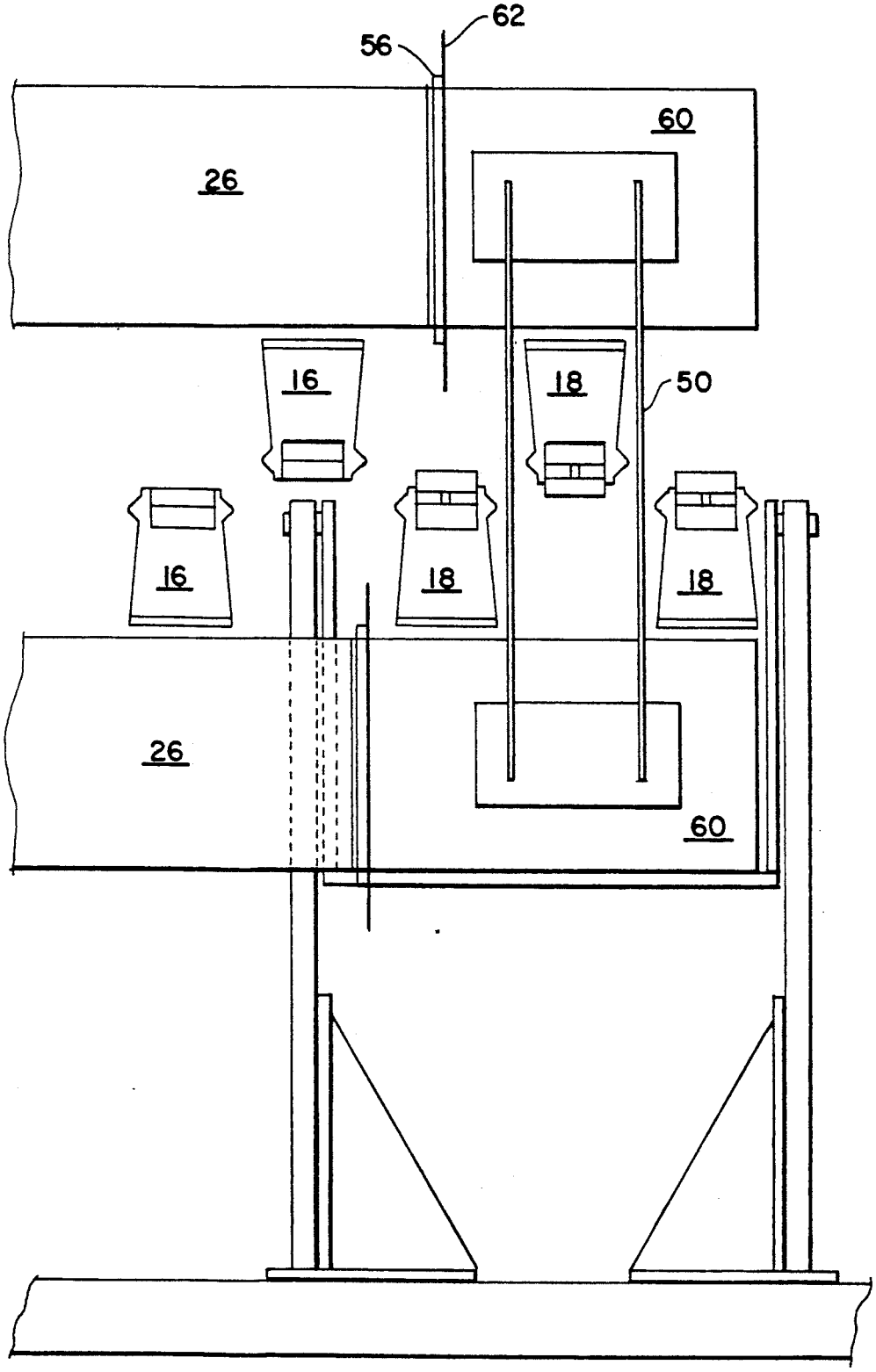
FIG. 6 is a side view of an alternate air supply means.

A preferred type of steerable air bar assembly of the invention is shown in FIGS. 4 and 5. However, in its broad aspects the invention is directed to any steerable air bar assembly comprising: i) a plurality of adjustable air bars, each having an elongated surface from which air may be discharged, said surface being in opposing relation to the running web, and each having two ends; ii) air supply means, in fluid communication with the air bars; and iii) adjustment means for altering the orientation of one or both of the elongated surfaces of the adjustable air bars with respect to the running web. In a preferred embodiment, one or both of the elongated surfaces is adjusted such that one or both of said surfaces rotate about an axis which is substantially parallel to the longitudinal centerline of the running web. Alternatively or additionally, the elongated surfaces may be rotated about an axis which is substantially perpendicular to the longitudinal centerline of the running web. In alternate embodiments of the invention, the adjustment means may comprise other angular adjustment means and pivoting support means, such as cables, air cylinders attached to rods, and other conventional means for providing adjustable movement. Additionally, in some applications it may be desirable to adjust the orientation of the upper and lower air bar/header assemblies individually. In these applications, the steerable air bar assembly would not include spacing means, e.g. the header carriage and support member described above. The spacing means would thus be eliminated, and separate adjustment means would be provided for each of the upper and lower air bar/header assemblies. The air bar/header assemblies may even in some instances be provided with adjustment means at each of their ends, as well as on both the upper and lower assemblies, such that each pair of air bar/header assemblies would have a total of four adjustment points.

Adjustment of the orientation of the air bar surfaces, via the adjustment means, may be accomplished manually by the dryer operator, by computer logic control, or by other means.

In a further embodiment of the invention, the steerable air bar assembly may further comprise back pressure means, as described hereinabove. The use of back pressure means on the steerable air bar(s) in the dryer may be in addition to or instead of such use on the fixed air bars as previously discussed.

The air supply means may alternately comprise a plurality of headers, such as that shown in FIG. 6, each header comprising a standard header air supply duct 26 (e.g. a conventional header supply duct which is used to supply other air bars in the dryer) with sealing gasket 56 at one end, an extension 60 to the air supply duct, and a sealing flange 62 disposed between the extension and the sealing gasket, such that air delivery may be maintained during angular adjustments of the air bar/header assembly. As shown in FIG. 6, adjustable air bars 18 are in air-receiving communication with extension 60, while fixed air bars 16 are in air-receiving communication with the standard header air duct 26. Additionally, other spacing means may be used in lieu of header carriage 36, provided that a fixed spatial relationship may be maintained between the upper and lower air bars. This type of air supply means is often preferred and would generally be necessary in a dryer such as the one shown in FIG. 1, as previously described.

Any type of air bar may be used in the present invention. Preferred types of air bars are described in U.S. Pat. Nos. 3,549,070, 3,873,013, and 3,964,656, the disclosure of which is incorporated herein by reference. Furthermore, any desired number of air bars may be used in an air bar/header assembly, e.g. 50 or more.

The steerable air bar assembly of the invention may be assembled using conventional methods, such as described in U.S. Pat. No. 3,776,440, the disclosure of which is incorporated herein by reference.

In practice, the position of the edge of the running web is monitored at one or more locations within the dryer, using conventional sensing means, such as fiber optics. Based on these measurements of the position of the web edge, the steerable air bars are adjusted, periodically or continuously, such that they provide a force which adjusts the web into a substantially straight path. Alternatively, instead of sensing the position of the web as it travels through the dryer, computer-generated data may be used to predetermine the desired web path and the anticipated web position, and to compare these two positions. The steerable air bars may then be adjusted based upon that comparison to adjust the position of the web to the desired web path. As mentioned hereinabove, back pressure means are placed on either fixed or steerable air bars at locations at which the web is expected to weave or drift. This also may be determined either experimentally, e.g. by conducting a dry run before running a given web through the dryer, or by the use of computer-generated data.

Thus, in its method aspects the present invention relates to a method of guiding a web in a substantially straight path, e.g. as it passes through a web dryer apparatus. This method comprises driving a web through the dryer, floatingly supporting said web, sensing the position of the web edge, and providing a force responsive to said sensing to adjust the position of the web. In an alternate embodiment of the invention, the method comprises predicting the position of the web, rather than sensing said position, either based on computer-generated data or experimentally obtained data. The adjusting force may be provided by one or more steerable air bars, by back pressure means, or a combination thereof.

While preferred embodiments of the invention have been described herein, other variations and modifications may be practiced by those skilled in the art without departing for the spirit and scope of the invention.

What is claimed is:

1. In apparatus for drying a web while floating said web in a substantially sinusoidal path, apparatus for guiding said web in a substantially straight sinusoidal path, comprising:

a) an upper and lower header, said upper header being positioned above said web and said lower header being positioned below said web;

b) one or more adjustable air bars, each having two ends and an elongated surface from which air may be discharged, the surface being in opposing relation to the web, each of said air bars being in air-receiving communication with one of said headers;

c) air supply means in communication with said headers for supplying air to said air bars for discharge; and d) adjustment means for altering the orientation of the elongated surfaces of the adjustable air bars with respect to the web by altering the orientation of one or both of said headers with respect to the web.

2. An apparatus of claim 1 wherein the orientation of said elongated surfaces is adjusted such that each said surface rotates about an axis which is substantially parallel to the longitudinal centerline of the web.

3. An apparatus of claim 1 wherein the orientation of said elongated surfaces is adjusted such that each said surface rotates about an axis which is substantially perpendicular to the longitudinal centerline of the web.

4. The apparatus of claim 1 wherein the air supply means comprises a flexible duct sealingly joined to each of said headers.

5. The apparatus of claim 1 wherein each header comprises a standard header air supply duct having sealing gasket at one end, an extension in communication with the air supply duct, and a sealing flange disposed between and in intimate contact with the extension and the sealing gasket, such that air delivery may be maintained during adjustment of the air bar by altering the orientation of the header with respect to the web.

6. An apparatus of claim 1 wherein the adjustment means comprises a jack, and a pivoting support means associated with the assembly.

7. An apparatus of claim 6 wherein said jack is a screw jack.

8. An apparatus of claim 1 comprising at least three adjustable air bars.

9. An apparatus of claim 1 wherein at least two adjustable air bars are situated in opposing spaced relation, such that the web passes between the two air bars.

10. A web dryer for drying a web while floating said web in a substantially sinusoidal path comprising:

a) an upper and lower header, said upper header being positioned above said web and said lower header being positioned below said web;

b) one or more adjustable air bars, each having two ends and an elongated surface from which air may be discharged, the surface being in opposing relation to the web, each of said air bars being in air-receiving communication with one of said headers;

c) air supply means in communication with said headers for supplying air to said air bars for discharge; and d) adjustment means for altering the orientation of the elongated surfaces of the adjustable air bars with respect to the web by altering the orientation of one of both of said headers with respect to the web.

11. A web dryer of claim 10 wherein the orientation of said elongated surfaces is adjusted such that each said surface rotates about an axis which is substantially parallel to the longitudinal centerline of the web.

12. A web dryer of claim 10 wherein the orientation of said elongated surfaces is adjusted such that each said surface rotates about an axis which is substantially perpendicular to the longitudinal centerline of the web.

13. A web dryer of claim 10 further comprising:

d) a plurality of fixed air bars, each having an elongated surface from which air may be discharged; back pressure means disposed above each of said elongated surfaces; said fixed air bars being positioned in spaced relation to said adjustable air bars along the length of the running web such that the running web is guided between said fixed and said adjustable air bars in a substantially straight path.

14. A web dryer of claim 13 wherein said elongated surfaces of the fixed air bars are oriented substantially perpendicular to the longitudinal centerline of the web.

15. A web dryer of claim 13 wherein said back pressure means comprises at least one edge dam.

16. A web dryer of claim 15 wherein said edge dam is a T-shaped member comprising an elongated dam member and a support member.

17. A web dryer of claim 16 wherein said elongated dam member extends above and approximately perpendicular to the fixed air bar elongated surface and is supported in this position by said support member, which is attached to the air bar by attachment means.

18. A web dryer of claim 13 wherein at least one of said fixed air bars has more than one edge dam.

19. A web dryer of claim 1 further comprising back pressure means associated with each of the adjustable air bar elongated surfaces.

* * * * *